United States Patent [19]

Shukla et al.

[11] Patent Number: 4,640,717

[45] Date of Patent: Feb. 3, 1987

[54] SUGAR PROCESS

[75] Inventors: Dipak P. Shukla, Reading; Keith Sinclair, Paddock Wood; Kevin A. Smith, Reading, all of England

[73] Assignee: Tate & Lyle Public Limited Company, London, England

[21] Appl. No.: 712,256

[22] Filed: Mar. 15, 1985

[30] Foreign Application Priority Data

Mar. 15, 1984 [GB] United Kingdom ..... 8406734

[51] Int. Cl.[4] ..... C13F 1/02

[52] U.S. Cl. ..... 127/58

[58] Field of Search ..... 127/15, 16, 58, 30

[56] References Cited

U.S. PATENT DOCUMENTS

| | | | |
|---|---|---|---|
| 3,197,338 | 7/1965 | Hurst et al. | 127/58 |
| 3,365,331 | 1/1968 | Miller | 127/30 |
| 3,486,469 | 12/1969 | Recas | 127/58 |
| 3,929,503 | 12/1975 | Yamauchi | 127/58 |
| 3,972,725 | 8/1976 | Nicol | 127/58 |
| 3,983,862 | 10/1976 | Spriet | 127/58 |
| 4,059,460 | 11/1977 | Schollmeier | 127/58 |
| 4,083,733 | 4/1978 | Asano et al. | 127/58 |
| 4,159,210 | 6/1979 | Chen et al. | 127/58 |
| 4,342,603 | 8/1982 | Daniels | 127/30 |
| 4,537,637 | 8/1985 | Hunter et al. | 127/58 |

*Primary Examiner*—R. B. Penland

*Attorney, Agent, or Firm*—Ostrolenk, Faber, Gerb & Soffen

[57] ABSTRACT

Sugar (sucrose or glucose) is crystallized by passing a hot supersaturated syrup to a continuous screw extruder such that progressive nucleation of the syrup is induced during a mean residence time of below 25 seconds and then discharging the nucleated syrup onto a surface, e.g. a conveyor belt, to crystallise without agitation.

10 Claims, No Drawings

SUGAR PROCESS

This invention relates to a crystallisation of sugars (sucrose and glucose) by the process generally known as "transformation".

The conventional process for producing crystalline sucrose involves charging a hot, concentrated syrup into pans, drawing a vacuum over the pans and evaporating a proportion of the water from the syrup. A portion of the sugar then crystallises out and is separated, generally by a centrifuge. The mother liquor is then recyled and reboiled to produce another crop of sugar cystals. This process may be repeated a number of times. Although an extremely pure sugar is produced in the first crop, subsequent crops are of decreasing purity. Moreover the process is very slow and complex and has other disadvantages, in particular that it can generally only be operated in a batchwise fashion.

Other processes have been proposed and operated which are based on the phenomenon known as transformation. In transformation, a supersaturated syrup is nucleated and then crystallized under conditions where the heat evolved in the exothermic crystallisation boils off the remaining water to give a substantially dry crystalline product. Commercially viable processes of this type loosely fall into two categories which are typified by the following two patented processes.

British Pat. No. 1 460 614 and U.S. Pat. No. 3,972,725 (Tate & Lyle Limited) describe a continuous process in which the syrup is catastrophically nucleated and immediately discharged into a crystallisation zone. The catastrophic nucleation is achievd by submitting the syrup to a shear force having a velocity gradient of at least 5,000 cm/sec/cm, more generally at least 10,000 or even 20,000 cm/sec/cm. Such shear force can be applied by apparatus in the form of a colloid mill or homogeniser in which the residence time is extremely short, e.g. from 0.0001 to 0.5 second. The emerging syrup is then crystallised, usually on a moving band, where the water boils off maintaining the crystallising material at a relatively constant temperature and yielding a substantially dry product. A related process is described in British Pat. No. 2070015B and U.S. Pat. No. 4,342,603 (Tate & Lyle Public Limited Company), applied to the crystallisation of glucose. As in the previously mentioned patent, a supersaturated syrup, in this case at least 65% supersaturated and of solids content greater than 95%, is subjected to a substantially instantaneous shear force and then allowed to crystallise on a belt. As before, the velocity gradient during shear is about 8000 to 30,000 cm/sec/cm in a colloid mill or up to about 3,000 cm/sec/cm using a restricted nozzle. The product is a dry microcrystalline glucose material containing at least 70% by weight of glucose in the $\beta$-form.

Both of these processes have proved extremely successful, but one problem can arise with them: because the nucleation is completed in such a short time, it is sometimes difficult to control the process to prevent rapid crystallisation blocking the outlet from the nucleation zone.

U.S. Pat. No. 3,365,331 (Miller, assigned to the American Sugar Company) and U.S. Pat. Nos. 4,338,350 & 4,362,757 (Amstar) describe a transformation process for sucrose involving impact beating of the concentrated sucrose syrup with full crystallisation in the same beating zone. The process involves the use of a "beater crystalliser" such as the so-called Turbulizer manufactured by the Strong-Scott Manufacturing Company, Minneapolis, U.S.A. The apparatus consists of a cylinder provided with rotating blades or paddles which are run at sufficient speed to "impact" the syrup rather than just stir it. In order to prevent overheating of the syrup, and to carry away water vapor, a forced gas flow is provided. In this process the shearing and beating is carried out throughout the crystallisation period, so that the product emerging from the apparatus is a solidified crystalline material. Naturally, the process involves the input of considerable amounts of energy and has problems related to temperature control. However, as described in U.S. Pat. No. 3,365,331 (column 9), the incorporation of "other additive materials which may have a food value or a taste value or a colour value or a medicinal value and the like" is described and this process does lend itself to the addition of such materials during the transformation step.

This is in contrast to the instantaneous nucleation type of process, e.g. using a colloid mill, where it is difficult to incorporate other additive materials which are particulate, for example milled nuts and cocoa.

Similarly, glucose has been crystallised by continuous working and kneading. U.S. Pat. No. 3,197,338 of Hurst el at., assigned to A. E. Staley Manufacturing Company discloses a process in which a glucose syrup is crystallised in a mixer or blender such as the Ko-Kneader manufactured in USA by the Baker-Perkins Company which comprises a single reciprocating worm screw and fixed projections on the machine casing. Typically the syrup is kneaded for several minutes, with cooling, to induce nucleation and subsequent crystallisation of the glucose. The emerging partially crystalline material is then rapidly cooled on a belt to prevent degradation and further crystallisation, the remaining molten syrup setting as a solid glass. The material is then ground to the required size but contains only about 50–70% crystalline glucose.

Another glucose crystallisation process is disclosed and claimed in GB 2077270B of CPC International Inc. In this process, starch hydrolysate is concentrated to about 92–99% solids and is then simultaneously crushed and mixed while it crystallises while cooling. Residence times in the shearing and crushing machine are on average about 2 to 3 minutes although times of up to 1 hour are mentioned during the whole of which time the material is being ground and mixed until a particulate crystalline mass is obtained. The product is then further milled.

These processes are closely related to the above-mentioned sucrose crystallisation process of U.S. Pat. No. 3,365,331, since they all involve the continuous beating, crushing or kneading of the mass during the whole of the crystallisation which occurs, over a period of several minutes, and also the since they need to control the temperature during the beating process.

There remains a need for a rapid, easy to control crystallisation process which does not involve high energy inputs, but which can be run continuously rather than in a batch-wise mode and which enables the incorporation of ingredients such as nut products and cocoa.

In developing the proces of British Pat. No. 1 460 614, the Nicol process, we have attempted to overcome the disadvantages mentioned above. A review of the art suggested that these two above-mentioned types of process represent the only effective possibilities. With the Nicol process, it appeared to be essential to have catastrophic nucleation, i.e. to nucleate the syrup as fast as possible and to discharge it from the restricted nucleation zone virtually instantaneously, in order to prevent overheating and hence sugar degradation and blockage caused by solidification. Conversely, gradual nucleation and crystallisation in the form adopted by the American Sugar Co. (Miller) process meant that the mixture must be kept moving throughout the process to prevent it setting solid in the equipment, and thus involved vigorous impact beating and cooling. It thus appeared impossible to "slow down" the Nicol process without implementing the beating the cooling techniques of the Miller process.

However, we have surprisingly now found that a more controlled, progressive nucleation can be effected by the use of certain types of apparatus which still enable the nucleated syrup to be discharged before substantial crystallisation has occurred, but at the same time permit the addition of extra materials.

According to this invention, we provide a process for the crystallisation of sucrose or glucose from a supersaturated sugar syrup in which the syrup is subjected to shear in an uncooled nucleation zone to induce nucleation of the syrup, the syrup is discharged from said nucleation zone before substantial crystallisation has taken place, and the syrup is thereafter allowed to crystallise without agitation, characterized in that shear is provided by a continuous screw extruder such that progressive nucleation of the syrup is induced, the syrup having an average retention time therein of below 25 seconds at a temperature of 115° to 145° C. for sucrose and 100°–135° C. for glucose.

By the term continuous screw extruder, we mean a mixing and milling machine of the type having one or more, preferably two, rotating screw members (Archimedean screws) of constant or varied pitch. In these mixers, the incoming material is entrained and compressed in the spaces between the screw blades and the casing and, in the case of a twin screw machine, between the two intermeshing screw blades. The pitches of two screws may be in parallel or opposed, depending on whether the screws co-rotate or counter-rotate, both versions being well known in the plastics milling field. For example, these machines are used to mill P.V.C. before extrusion. Typical machines are produced by Baker Perkins and include the GP, MP and MPF series. Other suppliers of this type of equipment include Werner & Pfleiderer, Stuttgart, and Le Creusot, Loire. One particularly preferred type of extruder has a twin screw system with two side-by-side screws co-rotating and intermeshing in a "barrel". The screws each comprise a longitudinal shaft (e.g. of 10:1 to 15:1 length:diameter) on which are disposed sections of screw, for example of about 25 mm pitch and 50 mm diameter, and sections of unpitched perpendicular "blades" or 'lens'-shaped agitators arranged to cooperate in pairs, one on each shaft. These blades are generally a pointed oval in shape, centered on the shaft, and may be, for example, about 12–13 mm thick and 50 mm in diameter. A twin-screw system is preferred for various reasons. The heat-transfer is better as all the material is continuously moved from the interior between the shafts to the exterior (i.e. the inner barrel surface), thus leading to a more consistent internal temperature. The transport is by positive displacement and does not rely on viscous friction between the blades and barrel and the material. The power consumption is about half that required for a single screw system, typically 400–600 kj/kg as opposed to 900–1500 kj/kg. Furthermore, the power is dissipated in many small shear forces rather than in large shear forces, thus aiding the rapid nucleation required.

The Baker Perkins MPF50D, for example, has a shaft diameter of 50 mm, an overall passage length of about 750 mm and has various entry ports along its length. The drive motor is located at the end away from which the contents travel. Conveniently, the syrup is pumped in through a port about 34 mm along the other additives are added through ports 600 mm or 720 mm along. Water vapour can be removed from a port near the motor end, e.g. about 90 mm along.

A machine of this type, operating at a typical rotation speed of 100 to 500, e.g. about 300 to 400, rev.min.$^{-1}$ can provide a sufficient nucleation in a mean retention time for the syrup of below 25 seconds, typically below 15, e.g. 2–11, seconds.

Having passed through a shear zone where it negotiates the interstices of the screws and blades or agitators of the extruder, the syrup then passes onto a moving band, optionally after first passing through a relatively quiescent, non-agitated zone of the extruder during which no further nucleation occurs but crystallisation of the nucleated syrup commences.

We find that under these conditions, the supersaturated syrup is sufficiently thoroughly and uniformly nucleated to crystallise rapidly and substantially completely on being discharged onto a moving band, but not so fast that substantial crystallisation has occurred before the syrup is discharged.

The feedstock for the process should be a supersaturated sucrose syrup, typically of 90°–95° Brix. Naturally, the lower the water content of the syrup, the easier it is to obtain a dry product, although the water content of the final product can be largely controlled by the degree of boiling occurring in the crystallising material discharged from the nucleation zone. With a syrup of the above concentration, working at a temperature of 125°–150° C., it is possible to obtain a dry, friable solid with an open structure and having a moisture content of about 4% by weight. Alternatively, a supersaturated glucose syrup, typically 95°–99° Brix, can be used. With glucose, little water is lost during the actual crystallisation. Further moisture can be removed from either product by the use of means, e.g. a conventional rotary drier, if desired.

As explained above, the crystallisation occurs outside the nucleation zone, and preferably on a moving band. We have found that, especially with sucrose, the loading of the band is important as it is necessary for the heat losses by radiation and conduction to be balanced by the exothermic crystallisation such that the temperature of the material on the belt does not fall below a certain critical temperature depending on the quality and concentration of the syrup. In a process of this type, complete crystallisation occurs by virtue of the fact that the water is driven off. It is thus important that the temperature of the crystallising magma does not drop below the boiling point of the water in the syrup. In fact, under optimum conditions, the crystallising magma becomes agitated by the boiling water vapor escaping from the solidifying mass.

The nucleated syrup leaving the nucleation zone is a creamy frothy liquid and is conveniently discharged directly onto a moving belt, in particular a rubber or steel band. Under such circumstances the loadng on the belt is preferably from 6 to 15 kg m$^{-2}$, most preferably about 10 kg m$^{-2}$. Crystallisation of the solidifying magma occurs during a period of about 0.5 to 10 minutes, preferably about 2 to 3 minutes, after which the product is a friable solid of open structure and, in the case of sucrose, the majority of the residual moisture has been driven off. A further period on the belt allows for cooling and hardening of the material. In order that the crystallisation proceeds rapidly and thoroughly, it is important that the syrup/magma is not allowed to cool too rapidly: certainly no actual cooling steps should be taken. Cooling during the crystallisation, in fact, halts crystallisation and leads to a glassy, less-crystalline product.

The product obtained from the band can be easily granulated to a required particle size and further dried to give a free-flowing sugar product which is granular and which can readily be dispersed and dissolved in water. It has, however, an attractive crunchy texture, particularly suited for use in confectionery, e.g. in chocolate bars. Other ingredients may then be combined with the product at this stage, in addition to or instead of the addition of ingredients to the syrup in the extruder.

Alternatively, the cake on the band may be cut or formed into shapes, e.g. confectionery bars, suitable for coating with chocolate, etc.

As indicated above, it is an advantage of the process according to this invention that other ingredients can be incorporated in the syrup being nucleated, so as to provide a granular sugar product containing the said ingredient. Typical ingredients include finely ground or chopped nuts including peanut puree, cocoa and chocolate products, bran, fruit flavourings, pectin, malt and so on. In general, the other ingredient may be added at any level up to about 50–65% by weight, preferably up to about 40–45% by weight. Alternatively, even higher amounts might be added to produce a different type of product in which the sugar is a minor, evenly dispersed component in an overall agglomeration. Alternatively, or in addition, it is desirable to add finely divided sugar, for example the 'fines' obtained after granulation and sieving of the product of the process. This material might act as additional seed for the crystallisation, but nevertheless its addition does not cause any increase in the degree of crystallisation of the emerging slurry: that is to say, the degree of crystallinity is effectively equal to the proportion of the added crystalline sugar. For example, a particulate material below about 710$\mu$ can be separated from the granulated product and returned to the extruder at a level of, say, 10–30% or even up to 50% by weight.

According to a further feature of the present invention, there is provided apparatus for producing crystalline sugar comprising means, including an evaporator, for supplying supersaturated syrup at the stated temperature, arranged to supply the syrup to a preferably twin-screw extruder and a conveyor belt arranged to collect crystallising syrup emerging from the extruder and to convey it at a substantially constant temperature while crystallisation proceeds.

The following examples illustrate the invention further.

EXAMPLE 1

A sugar syrup containing 85–87% sucrose was evaporated to a supersaturated syrup of about 93° Brix at about 130°–145° C., typically about 138° C. The syrup was then pumped to a Baker Perkins MP50 twin-screw extruder with co-rotating screws of a 15:1 length:diameter ratio and 50 mm diameter and shaft-driven agitators and screws. The flow rate was adjusted so that the syrup was nucleated and beginning to crystallise as it emerged from the agitation zone (residence time about 2–8 seconds). It was then led directly onto a moving steel band and allowed to crystallise without substantial temperature drop. Water boiled off during the period on the band. The solidified crystalline mass was then cooled and broken up and granulated. A friable, "crunchy" product was obtained.

EXAMPLE 2

Dextrose monohydrate was dissolved in water to give a 40% solids solution. This was evaporated to about 97.5% solids in two continuous stages by using plate heat exchangers and vacuum separators. A liquor temperature of 87° C. at 83% solids was obtained at the first stage. A liquor temperature of around 107° C. at 97.8% solids was obtained at the second stage. The evaporated liquor was pumped continuously into the extruder used in Example 1 where it was continuously agitated and discharged, onto a moving band where crystallisation occurred within 4–6 minutes. The residence time in the extruder at a discharge flow rate of 1.0 kg/min was between 3–15 seconds with a screw rotation speed of 300 rev.min$^{-1}$. The product contained 2.2% water and was at least 75% crystalline. It was broken up into pieces and granulated.

EXAMPLE 3

The process of Example 1 was modified as follows. Bran was fed to the first inlet port on the mixer (furthest from discharge end) by means of a screwfeeder. The bran feed rate was varied to give the desired level (20% by weight). The evaporated sucrose liquor was discharged at 131° C. into the second inlet port on the mixer. The bran and sucrose were mixed, blended and agitated while being conveyed to the discharge end of the mixer, the residence time being between 3 and 15 seconds. The mix was discharged onto a moving band at 124° C. with an initial moisture content of 6.3%. Crystallisation on the band produced a cake within 3–6 minutes which was then granulated through a 5 mm screen. The product had a moisture content of 4.2%, owing to water loss on the band. The granulated material was then rotary dried and sieved to a 1–2.5 mm size, to give a final moisture content of 2.1%.

EXAMPLE 4 RAW SUGAR

A 67% solution of raw sugar and water was evaporated up to 83% solids. This syrup was then evaporated and heated to 137.8° C. by passing through a plate heat exchanger, before being discharged into the extruder port situated 34 cm from the motor end. The water vapour was removed from the extruder at a port situated 9 cm from the motor end, leaving a sugar syrup between 90 and 95% solids. The extruder was run at 400 rev.min$^{-1}$ to discharge a foamy syrup onto a moving crystallisation belt at a rate of 88 kg/hr. The syrup rapidly transformed and was granulated after 3 minutes. The product was put through a rotary drier and classified. The moisture content of the product was 1.9%.

EXAMPLE 5 RAW SUGAR AND BRAN

A 67% solution of raw sugar and water was evaporated up to 83% solids. This syrup was evaporated and heated to 138.9° C. by passing through a plate heat exchanger, before being discharged into the extruder port situated 34 cm from the motor end. The water vapour was removed from the extruder at a port situated 9 cm from the motor end, leaving a sugar syrup of between 90 and 95% solids. A single screw solids feeder fitted perpendicularly to the extruder at a side port 60 cm from the motor metered in bran at a rate of 37.7 kg/hr. The extruder was run at 400 rev.min$^{-1}$ discharging the sugar and bran mixture onto the moving conveyor band, where it foamed and the sugar crystallised. The material was granulated after 2 minutes, rotary dried and classified. The product was free-flowing and crunchy with a bran content of 30% and a moisture content of 2.6%.

EXAMPLE 6 COCOA

A sucrose liquor containing not more than 0.3% invert and 0.13% ash at 67% sucrose solids was evaporated up to 83% solids. This syrup was evaporated and heated to 135.3° C. by passing through a plate heat exchanger, before being discharged into the extruder port situated 34 cm from the motor end. The water vapor was removed from the extruder at a port situated 9 cm from the motor end, leaving sugar syrup of between 90 and 95% solids. A single screw solids feeder fitted perpendicularly to the extruder at a side port 60 cm from the motor metered in cocoa at a rate of 22 kg/hr. The extruder was run at 400 rev.min$^{-1}$ discharging the sugar and cocoa mixture onto the moving conveyor band, where it foamed and the sugar crystallised. The material was granulated after 2 minutes, rotary dried and classified. The product was free-flowing and crunchy with a cocoa content of 18% and a moisture content of 1.4%.

EXAMPLE 7 PEANUT PASTE

A sucrose liquor containing not more than 0.3% invert and 0.13 ash at 67% sucrose solids was evaporated up to 83% solids. This syrup was evaporated and heated to 135° C. by passing through a plate heat exchanger, before being discharged into the extruder port situated 34 cm from the motor end. The water vapour was removed from the extruder at a port situated 9 cm from the motor end, leaving a sugar syrup of between 90 to 95% solids. A wide throat mono-pump containing peanut paste was connected to a port situated 60 cm from the motor end and the paste was pumped in at a rate of 29 kg/hr. The extruder was run at 400 rev.min$^{-1}$, discharging the sugar and peanut mixture onto the moving conveyor band, where the sugar crystallised. The material was granulated after 2 minutes, rotary dried and classified. The product had a peanut content of 25% and a moisture content of 1.4%.

EXAMPLE 8 LEMON FLAVOUR

A sucrose liquor containing not more than 0.3% invert and 0.13% ash at 67% sucrose solids was coloured yellow with a food additive and then evaporated up to 83% solids. The syrup was evaporated and heated to 135° C. by passing through a plate heat exchanger, before being discharged into the extruder port situated 34 cm from the motor end. The water vapour was removed from the extruder at a port situated 9 cm from the motor end, leaving a sugar syrup of between 90 and 95% solids. Two lemom flavours and buffered lactic acid were independently metered into the extruder at a port situated 72 cm from the motor end. The two lemon flavours were set to pump in 931 g/hour each and the lactic acid 2.07 Kg/hour. The extruder was run at 400 rpm discharging the sugar, acid and flavour mixture onto the moving conveyor band, where the sugar crystallised. The material was granulated after 2 minutes, rotary dried and classified. The product was free-flowing and crunchy with a sharp lemon flavour and a moisture content of 1.4%.

EXAMPLE 9 IMPURE SUGAR

An impure sucrose syrup at 67% solids containing 1.8% ash, 2.5% invert and a total sucrose content of 92% was evaporated up to 83% solids. This syrup was then evaporated and heated to 140° C. by passing through a plate heat exchanger, before being discharged into the extruder port situated 34 cm from the motor end. In this case, water vapour was flashed off in the atmosphere while it was being discharged into the extruder port. The extruder in this case had a length:diameter ratio of 10:1 and was run at 250 rev.min$^{-1}$ to discharge a foamy syrup onto a moving crystallisation belt at a rate of 88 kg/hr. The syrup rapidly transformed and was granulated after 4.3 minutes. The product was put through a rotary drier and classified.

We claim:

1. In the process for the crystallisation of sucrose or glucose from a supersaturated sugar syrup comprising subjecting the syrup to shear in an uncooled nucleation zone to induce nucleation of the syrup, discharging the syrup from said nucleation zone before substantial crystallisation has taken place, and allowing the syrup to crystallise without agitation, the improvement which comprises providing the shear by a continuous screw extruder to induce progressive nucleation of the syrup at an average retention time in said screw extruder of less than 25 seconds and a temperature of 115° to 145° C. for sucrose and 100–135° C. for glucose.

2. A process according to claim 1, in which the extruder in a twin-screw extruder.

3. A process according to claim 1 or claim 2, in which the extruder has a shaft length to diameter ratio of from 10:1 to 15:1.

4. A process according to claim 1 or claim 2, in which the extruder runs at 100–500 rev.min$^{-1}$.

5. A process according to claim 1 or claim 2, in which the mean retention time in the extruder less than 15 seconds.

6. A process according to claim 5, in which the mean retention time is 2–11 seconds.

7. A process according to claim 1 in which the crystallisation occurs on a moving belt.

8. A process according to claim 7, in which the belt loading is from 6–15 kg m$^{-2}$.

9. A process according to claim 1 in which at least one other ingredient is incorporated into the syrup being nucleated.

10. A process according to claim 9 in which the other ingredient is introduced separately into the extruder.

* * * * *